US011413511B1

(12) United States Patent
Lee

(10) Patent No.: US 11,413,511 B1
(45) Date of Patent: Aug. 16, 2022

(54) GOLF TOOL KIT

(71) Applicant: Sun yoeng Lee, Dongducheon-si (KR)

(72) Inventor: Sun yoeng Lee, Dongducheon-si (KR)

( * ) Notice: Subject to any disclaimer, the term of this patent is extended or adjusted under 35 U.S.C. 154(b) by 0 days.

(21) Appl. No.: 17/325,206

(22) Filed: May 20, 2021

(30) Foreign Application Priority Data

Apr. 21, 2021 (KR) ..... 10-2021-0051468

(51) Int. Cl.
*A63B 57/20* (2015.01)
*A63B 57/50* (2015.01)
*A63B 47/04* (2006.01)

(52) U.S. Cl.
CPC ..... *A63B 57/203* (2015.10); *A63B 47/04* (2013.01); *A63B 57/207* (2015.10); *A63B 57/50* (2015.10); *A63B 2209/08* (2013.01)

(58) Field of Classification Search
CPC ..... A63B 57/203; A63B 47/04; A63B 57/207; A63B 57/50; A63B 2209/08
See application file for complete search history.

(56) References Cited

U.S. PATENT DOCUMENTS 3,298,579 A * 1/1967 Smith ..... A45F 5/021 224/183
3,799,331 A * 3/1974 White ..... A63B 57/00 206/38
4,730,728 A * 3/1988 Larkin ..... A63B 57/20 224/675
5,494,202 A * 2/1996 Wyatt ..... A63B 57/207 224/919
5,782,708 A * 7/1998 Kimball, Jr. ..... A63B 57/50 473/408
5,799,853 A * 9/1998 Brewster ..... A63B 57/207 224/679
6,095,934 A * 8/2000 Ohama ..... A63B 57/207 473/406
6,193,121 B1 * 2/2001 Chang ..... A63B 57/20 206/5
6,220,973 B1 * 4/2001 Hsu ..... A63B 57/203 473/406
8,882,605 B1 * 11/2014 Lee ..... A63B 57/353 224/901.2
2003/0010796 A1 * 1/2003 Hurtgam ..... A63B 57/207 224/269
2018/0126237 A1 * 5/2018 Ivone, Jr ..... A63B 57/207

FOREIGN PATENT DOCUMENTS

KR 10-0653919 B1 12/2006
KR 10-0756733 B1 9/2007
KR 20-2010-0011198 U 11/2010
KR 10-1891062 B1 9/2018

* cited by examiner

*Primary Examiner* — Steven B Wong
(74) *Attorney, Agent, or Firm* — Revolution IP, PLLC

(57) ABSTRACT

The present invention relates to a golf tool kit, and more particularly, to a golf tool kit including a tool box part in which an inner surface of a front case and an inner surface of a rear case are coupled to face each other with a buffer part provided therebetween and which has a belt clip formed on an outer surface of the rear case, a tee storage part in which a tee is stored by being inserted into an upper portion of the tool box part, a golf accessory storage part formed to arrange golf supplies on a surface of the tool box part, and a towel part formed in a lower portion of the tool box part so that a towel is changeable.

7 Claims, 7 Drawing Sheets

GOLF TOOL KIT

CROSS-REFERENCE TO RELATED APPLICATION

This application claims priority to and the benefit of Korean Patent Application No. 10-2021-0051468 filed on Apr. 21, 2021, the disclosure of which is incorporated herein by reference in its entirety.

BACKGROUND

1. Field of the Invention

The present invention relates to a golf tool kit, and more particularly, a golf tool kit in which golf tools are provided and a tool box part with an easily replaceable towel is formed so that a golfer may withdraw and use golf supplies as needed during a game.

2. Discussion of Related Art

In general, golf supplies include various golf accessories for a golfer in addition to basic equipment including 14 golf clubs, a driver, golf balls, and a golf bag.

Generally, golf accessories include golf gloves, tees, ball markers, divot tools, golf club cleaning brushes, towels, golf club grip holders, or the like. Meanwhile, a golfer stores some of the golf accessories in his or her pockets and takes out and uses some golf accessories whenever necessary, and thus, the golfer tends to become distracted and lose concentration.

Golf is a very sensitive sport, and thus, trivial factors may affect swing and a direction of a golf ball. Therefore, a golfer needs to properly use golf accessories to get the best possible results.

When playing a golf game, a golfer keeps his or her golf supplies in their pockets and then takes the golf supplies out and uses them whenever necessary.

However, in this case, there is a disadvantage in that it is difficult to select and take out necessary specific golf supplies because various golf supplies are put in the pockets at once.

In addition, among the golf supplies, the towel is an essential item for cleaning golf clubs or golf balls and should be kept wet.

For example, when a wet towel is carried in a golfer's pocket, gloves or clothes become wet. Accordingly, the wet towel should be stored separately in a specific place. In addition, whenever the towel is necessary, it is necessary to move a place where the towel is stored, wipe a golf club and a golf ball, and return the towel after cleaning. Accordingly, the cleaning is practically impossible during a golf game.

Therefore, most golfers remove foreign substances from a face of a golf club with bare hands or by using soles of shoes or lower ends of pants during a game where it is not easy to use a towel. Accordingly, it is difficult to clean foreign substances completely, clothes of the golfer become dirty, and the skin of the golfer is exposed to pesticides sprayed on a lawn.

In addition, since the ball marker among the golf supplies is stored in pockets, the ball marker is likely to be lost during a game, and since a size of the ball marker is small, it is difficult to find the ball marker.

Moreover, when searching for a tee in a pocket, there is a problem in that a palm or a finger is stabbed with an end of the tee.

CITATION LIST

Patent Literature

[Patent Document 1] Korean Utility Model Application No. 20-2010-0011198 (published on Nov. 17, 2010)

SUMMARY OF THE INVENTION

The present invention is directed to providing a golf tool kit in which golf supplies necessary for a golf game are attached in a built-in type by a magnetic force so that the golf supplies do not interfere with each other and a golfer may easily withdraw and use the golf supplies whenever necessary.

Moreover, the present invention is directed to providing a golf tool kit in which, when a tee with foreign substances is inserted into a tool box part, the foreign substances may be discharged to the outside through a discharge part formed in an inner lower portion of the tool box part.

In addition, the present invention is directed to providing a golf tool kit in which a towel connected to a towel belt is provided in a towel ring formed at a lower portion of a tool box part so that contaminated golf clubs or golf balls may be easily cleaned, and the towel may be folded by an attachment unit so that a golfer may play a golf game without interference from the towel.

In addition, the present invention is directed to providing a golf tool kit in which a towel belt coupled to a towel ring is easily separated by forming a rotating part at a belt clip so that the tool box part may be rotated at a desired angle.

According to an aspect of the present invention, there is provided a golf tool kit including a tool box part in which an inner surface of a front case and an inner surface of a rear case are coupled to face each other with a buffer part provided therebetween and which has a belt clip formed on an outer surface of the rear case, a tee storage part in which a tee is stored by being inserted into an upper portion of the tool box part, a golf accessory storage part formed so that golf supplies are arranged on a surface of the tool box part, a towel part formed in a lower portion of the tool box part so that a towel is replaceable, and a discharge part formed in an inner lower portion of the tool box part to discharge foreign substances to an outside of the tool box part, wherein the discharge part includes a pair of inclined plates that protrude upward from an inner lower surface of the tool box part and a pair of discharge holes formed to pass through the inner lower surface of the tool box part each at one end of the inclined plates.

The tee storage part may further include at least one insertion hole which is formed in an upper portion of the tool box part and into which the tee is inserted, a contact hole formed in an upper portion of an inner surface of the tool box part and formed in one surface of a plate to be pressed against an outer peripheral surface of the tee passing through the insertion hole, and a rib having a pair of plates at both sides of the contact hole.

The golf accessory storage part may further include a tool storage part having grooves formed so that a divot tool is disposed in an upper portion of an outer surface of the front case, a ball marker is disposed below the divot tool, and a brush is disposed at one side of the ball marker, and a bump protruding from an outside of the tool storage part to surround a portion of each of the divot tool and the brush.

The golf accessory storage part may further include a magnet receiving part accommodating a magnet material corresponding to the tool storage part on the inner surface of the front case, and a magnet rib protruding from the inner surface of the rear case toward the magnet receiving part, in which the magnet receiving part may attach the divot tool, the ball marker, and the brush to one surface of the tool storage part by a magnetic force of the magnet material.

The towel part further may include a towel ring formed in a lower portion of the buffer part, a towel belt having one side sewn and coupled to an upper one surface of the towel and the other side passing through the towel ring fastened to a button formed on one side of the upper one surface of the towel so as to form a ring button, and an attachment part formed in a lower portion of the towel so that an attachment unit is formed to fold the towel, in which when the towel is folded, a golf ball is temporarily stored in the attachment part and then is taken out from the attachment part.

The golf tool kit may further include a rotating part that rotates the tool box part about the belt clip, in which the rotating part includes a rotation shaft part protruding from one surface of the belt clip to rotatably receive the rotation clip, a rotation groove formed in the outer surface of the rear case to accommodate the rotation shaft part so that one end of the rotation clip is helically coupled to the rotation groove, a rail having a wall protruding from and along a circumference of the rotation groove, and a rotation rail that has a wall spaced apart from the rotation shaft part to accommodate the rail and rotates in the same direction as that of the rotation shaft part.

The golf tool kit may further include a stopper that restricts a rotation of the rotating part, in which the stopper may include a rotation protrusion protruding from an inner surface of the rotation rail to form a protrusion having a curved line corresponding to a circumference of the rail, and a control protrusion protruding from an outer surface of the rail at an angle of at least 90° or less about the rotation shaft part.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
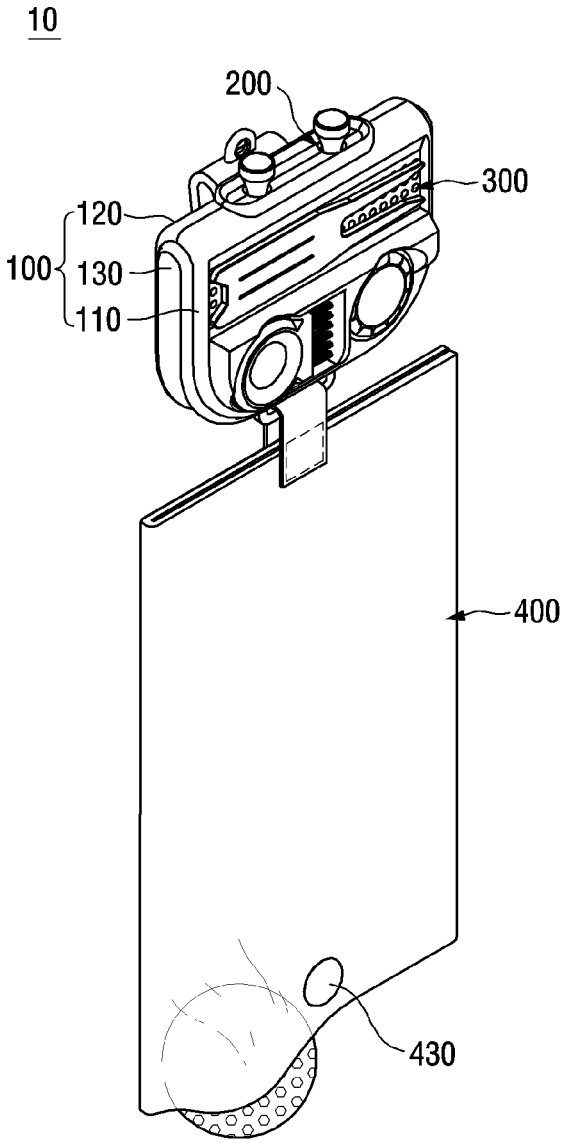
FIG. 1 is a perspective view schematically illustrating an exterior of a golf tool kit according to one embodiment of the present invention.

Hereinafter, with reference to the accompanying drawings, exemplary embodiment will be described in detail so that a person of ordinary skill in the art to which the present invention belongs may easily implement the present invention. However, when it is determined that a detailed description of a related known function or configuration may unnecessarily obscure a gist of the present invention in describing an operating principle of the present invention in detail, the detailed description thereof will be omitted.

In addition, same reference numerals are used for portions having similar functions and functions throughout the drawings.

In addition, when a portion of the specification is described to be "connected" to another portion, the connection includes not only being directly connected to another portion but also being indirectly connected to another portion with another component interposed therebetween. In addition, "including" a certain component means that other components may be further included, rather than excluding other components unless specifically stated to the contrary.

Hereinafter, a golf tool kit according to an exemplary embodiment of the present invention will be described in detail with reference to the accompanying drawings.

Figure 2:
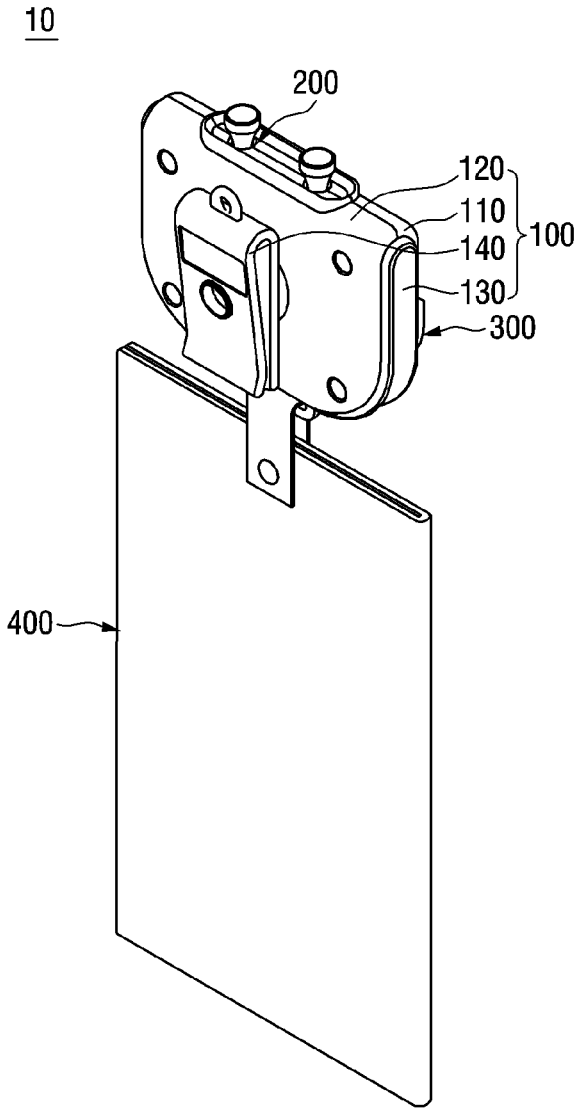
FIG. 2 is a rear perspective view illustrating a rear surface of FIG. 1.

As illustrated in FIGS. 1 and 2, a golf tool kit 10 according to one embodiment of the present invention includes a tool box part 100, a tee storage part 200, a golf accessory storage part 300, and a towel part 400.

Figure 3:
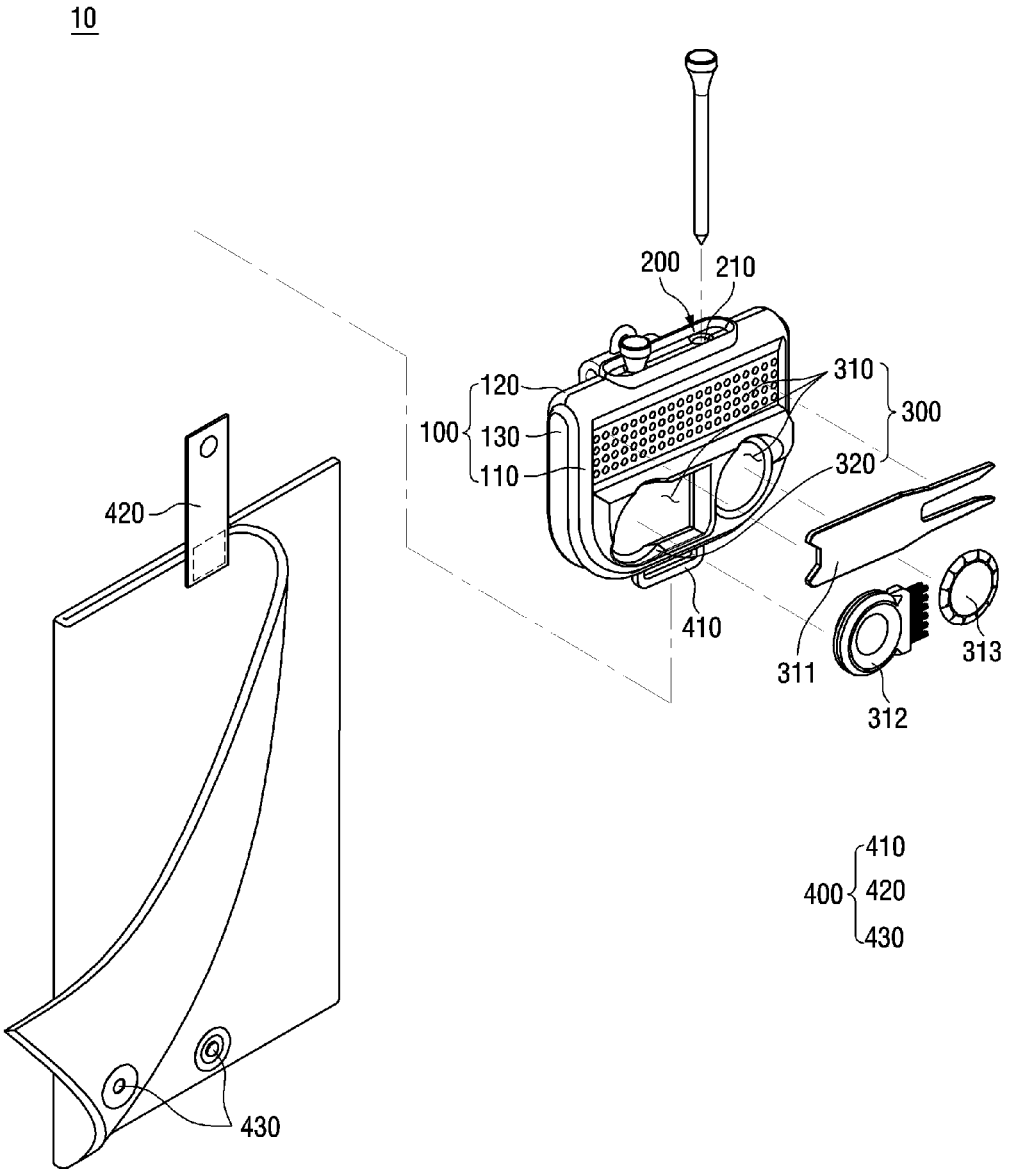
FIG. 3 is an exploded perspective view illustrating the golf tool kit of FIG. 1.

More specifically, as illustrated in FIGS. 2 and 3, the golf tool kit 10 according to one embodiment of the present invention includes the tool box part 100 in which an inner surface of a front case 110 and an inner surface of a rear case 120 are connected to face each other with a buffer part 130 provided therebetween, and a belt clip 140 is formed on an outer surface of the rear case 120, a tee storage part 200 in which a tee is stored by being inserted into an upper portion of the tool box part, a golf accessory storage part 300 formed so that golf supplies are arranged on a surface of the tool box part, and a towel part 400 formed in a lower portion of the tool box part so that a towel is replaceable.

Referring to FIGS. 1 and 2, the tool box part 100 includes the front case 110 in which the golf supplies are attachable to the outer surface, the inner surface of the rear case 120 and the inner surface of the front case 110 are connected to face each other, and thus, the tool box part 100 is formed in a casing shape.

In this case, a buffer part 130 having a "U"-shaped frame with an open upper portion is disposed between and connects the front case 110 and the rear case 120. Here, the buffer part 130 prevents a tensile force caused by an operation of pulling the towel from being transmitted to the front case 110 and the rear case 120 and improves durability.

In addition, in the tool box part 100, the belt clip 140 is formed on the outer surface of the rear case 120 so that the tool box part is detachably coupled to a belt of a golfer.

Figure 4:
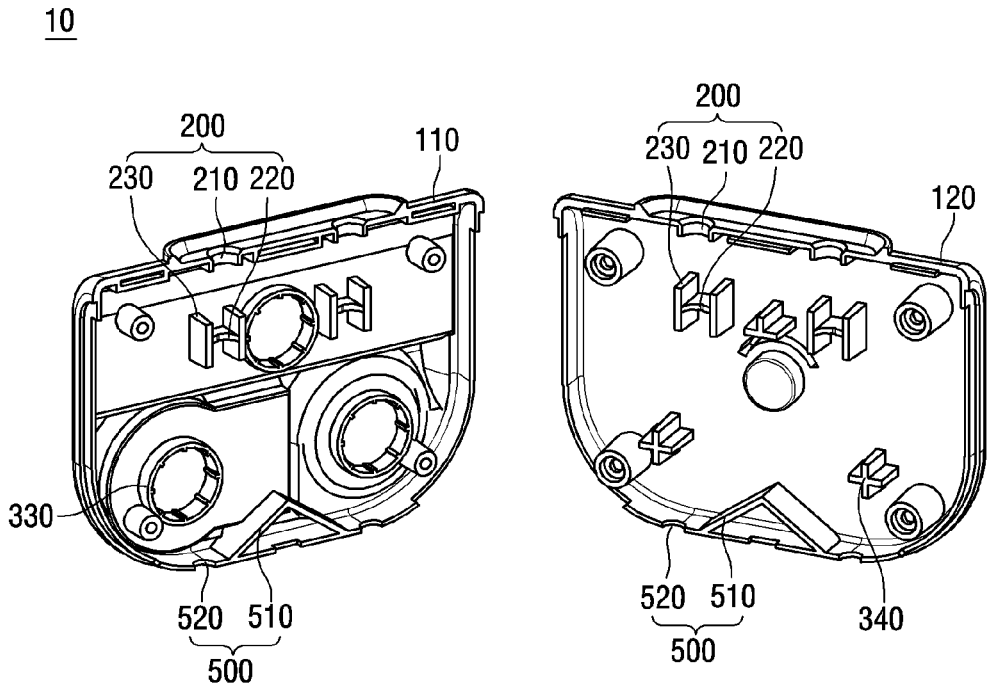
FIG. 4 is an exemplary view illustrating a golf accessory storage part and a discharge part formed on an inner surface of a tool box part of the golf tool kit according to one embodiment of the present invention.
Figure 5:
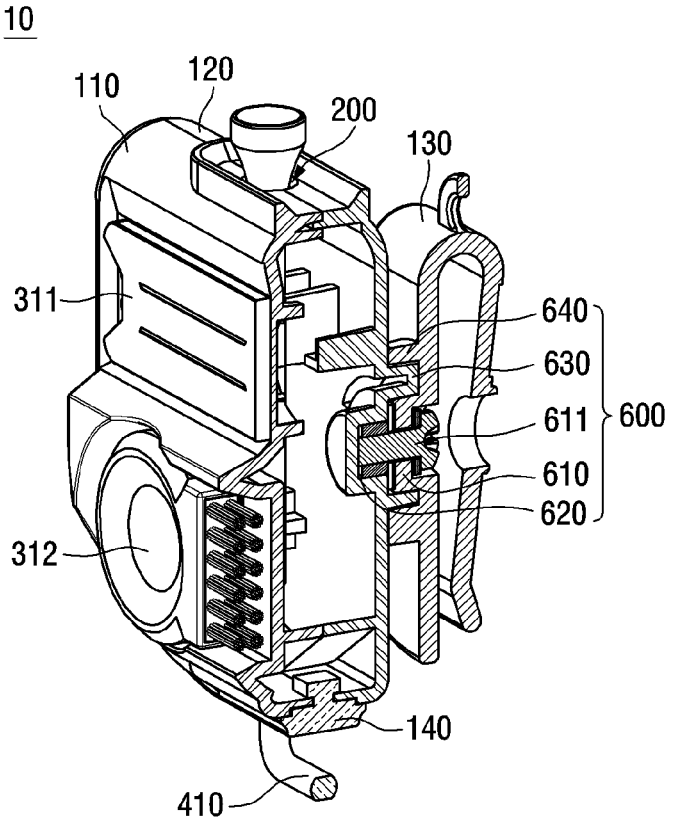
FIG. 5 is a cross-sectional perspective view illustrating a rotating part of a golf tool kit according to one embodiment of the present invention.

Referring to FIGS. 3 and 4, a tee is inserted into an upper portion of the tool box part 100 and stored in the tee storage part 200.

To this end, the tee storage part 200 further includes an insertion hole 210, a contact hole 220, and a rib 230.

The insertion hole 210 may be provided as at least one hole in an upper portion of the tool box part 100 so that a tee is inserted thereinto, a semicircular portion passing through an upper portion of the front case 110 and a semicircular portion passing through an upper portion of the rear case 120 are coupled to face each other, and thus, each insertion hole 210 is formed.

The contact hole 220 is formed in an upper portion of the inner surface of the tool box part 100 and is formed on one surface of a plate to be pressed against an outer peripheral surface of the tee passing through the insertion hole 210.

In particular, the contact hole 220 prevents the tee located inside the tool box part 100 from moving due to the golfer's walking or swinging motion, and thus, it is possible to prevent the tee from being separated from the tool box part 100.

The rib 230 includes a pair of plates supporting both sides of the contact hole 220.

That is, the pair of plates of the rib 230 are disposed at right angles at both sides of a plate forming the contact hole 220 to prevent the plate from shaking in a right-left direction.

Referring to FIGS. 1 and 3, in the golf accessory storage part 300, golf supplies are arranged on the surface of the tool box, and the golf accessory storage part 300 further includes a tool storage part 310 and a bump 320.

In the tool storage part 310, grooves are formed so that a divot tool 311 is disposed in an upper portion of the outer surface of the front case 110, a ball marker 312 is disposed below the divot tool 311, and a brush 313 is disposed on one side of the ball marker 312.

In particular, it is preferable that the tool storage part 310 is recessed from the outer surface of the front case 110 to form a stepped groove so that the divot tool 311, the ball marker 312, and the brush 313 are built-in.

In addition, the tool storage part 310 may be formed in a built-in type part capable of attaching and fixing each of the golf supplies to the groove with Velcro.

The bump 320 protrudes to the outside of the tool storage part 310, surrounds a portion of each of the divot tool 311 and the brush 313, and prevents arbitrary attachment or detachment of the golf supplies.

In addition, as illustrated in FIG. 4, the golf accessory storage part 300 of the golf tool kit 10 according to one embodiment of the present invention may further include a magnet receiving part 330 and a magnetic rib 340.

The magnet receiving part 330 has a hole in which a magnet material is accommodated in correspondence with the tool storage part 310 on the inner surface of the front case 110. In addition, the magnet receiving part 330 may have a contact rib which is pressed against the outer peripheral surface of the magnet material along an inner surface of the hole.

In particular, the magnet receiving part 330 serves to attach the divot tool 311, the ball marker 312, and the brush 313 to one surface of the tool storage part 310 by a magnetic force of the magnet material. For this reason, a built-in type coupling structure may be provided in which each golf supply may be more securely attached to the front surface of the tool box part 100.

The magnetic rib 340 protrudes toward the magnet receiving part 330 on the inner surface of the rear case 120.

This magnetic rib 340 is to prevent separation of the magnet material by coming into contact with one surface of the magnet material.

Referring to FIGS. 1 and 3, the towel part 400 is provided in a lower portion of the tool box part 100 so that the towel is replaceable.

To this end, the towel part 400 further includes a towel ring 410, a towel belt 420, and an attachment part 430.

Here, the outside of the towel is waterproofed with silicone. Accordingly, even when the inside of the towel is wetted with water and carried in a folded state, a golf club face and a ball may be cleaned without getting the golfer's pants or hands wet. In addition, in rainy weather, it is desirable to keep the inside of the towel dry so that water from wet hands or golf club grips may be wiped off.

The towel ring 410 is formed in a lower portion of the buffer part.

One side of the towel belt 420 is sewn and coupled to an upper one surface of the towel, and the other side thereof passes through the towel ring 410 and is fastened to a button formed on one side of an upper one surface of the towel so as to form a ring button.

Therefore, the towel belt 420 may be easily separated from and coupled to the towel ring 410 using the ring button, and thus, the towel may be quickly replaced.

In addition, since the wet towel is turned over and coupled after the golf game, the towel may be easily dried.

In addition, the towel belt 420 is not limited as long as it is formed of not only buttons but also Velcro or magnets that may be coupled to each other.

The attachment part 430 is formed in the lower portion of the towel to form an attachment unit capable of folding the towel.

In particular, in the attachment part 430, the towel may be folded, and thus, the golf ball may be temporarily stored and then taken out therefrom.

In other words, in the attachment part 430, it is possible to accommodate the golf ball by folding the towel and forming a pocket with open upper and side surfaces thereof. Moreover, it is possible to take the golf ball out of the lower portion of the folded towel through a spacing of the attachment unit.

In this case, since the inner surface of the folded towel may clean the golf ball, hassle of cleaning the golf ball may be reduced.

Here, it is preferable that the attachment part 430 is formed on both sides of the towel so that the other surface of the towel may be folded.

Meanwhile, as illustrated in FIG. 4, the golf tool kit 10 according to one embodiment of the present invention may further include a discharge part 500.

The discharge part 500 is formed in an inner lower portion of the tool box part 100 and serves to discharge foreign substances on the tee to the outside.

To this end, preferably, the discharge part 500 includes a pair of inclined plates 510 that rises upward from an inner lower surface of the tool box part 100 and a discharge hole 520 formed to pass through a side of each of the inclined plates 510.

The inclined plate 510 is formed in each of the front case 110 and the rear case 120 to form an inclined surface lowered to both sides from a center of an inner lower side of the tool box part 100 when the front case 110 and the rear case 120 are coupled to each other.

The discharge hole 520 are formed to pass through the inner lower surface of the tool box part 100, each discharge hole 520 formed at one end of the inclined plates 510.

For this reason, the foreign substances on the tee move along the inclined plate 510 and are discharged to the outside through the discharge hole 520.

Figure 6:
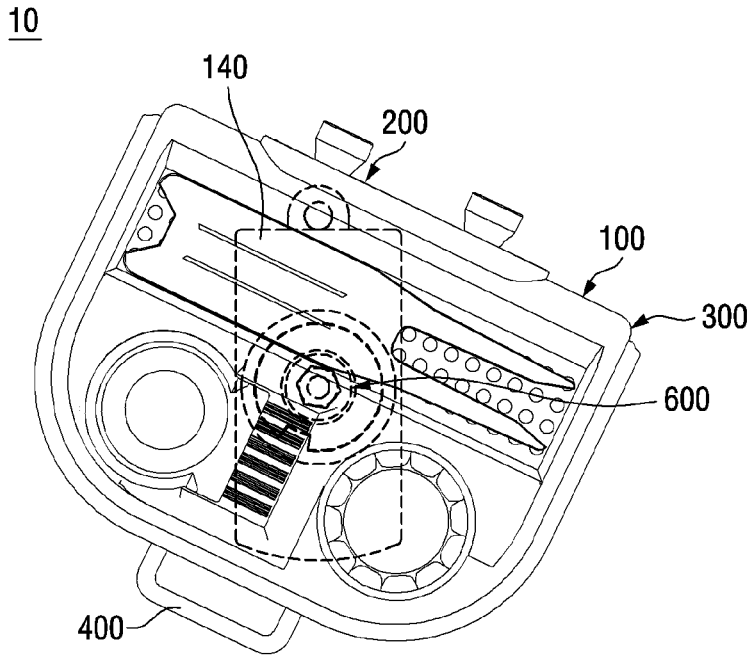
FIG. 6 is an exemplary view illustrating a state in which the golf tool kit according to one embodiment of the present invention is rotated.
Figure 7:
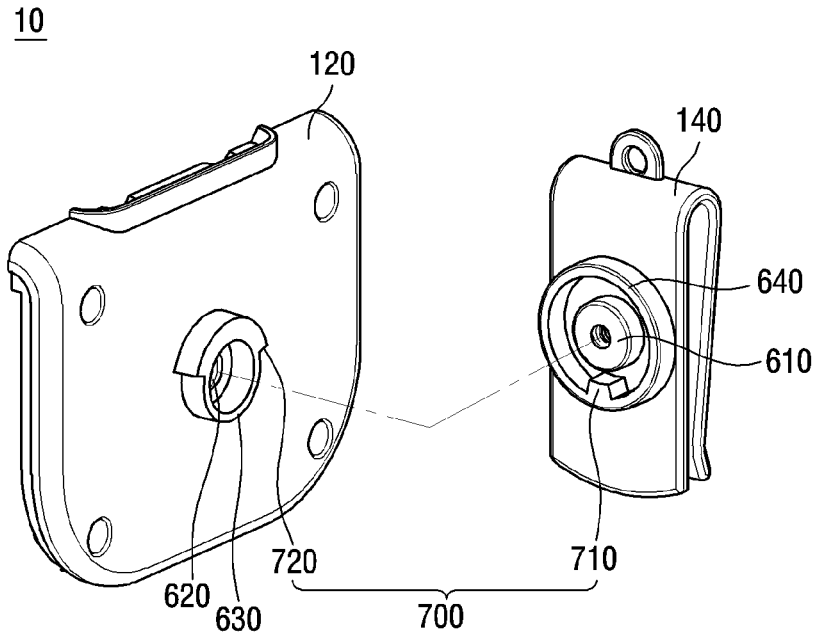
FIG. 7 is an exemplary view illustrating a stopper of the golf tool kit according to one embodiment of the present invention.

In addition, as illustrated in FIGS. 6 and 7, the golf tool kit 10 according to the embodiment of the present invention may further include a rotating part 600.

The rotating part 600 rotates the tool box part 100 about the belt clip 140.

To this end, the rotating part 600 further includes a rotation shaft part 610, a rotation groove 620, a rail 630, and a rotation rail 640.

The rotation shaft part 610 protrudes to rotatably receive the rotation clip 611 on one surface of the belt clip 140.

In addition, the rotation shaft part 610 is formed to have a length of 3 mm to 5 mm so that the tool box part 100 and the belt clip 140 are separated from each other to prevent the rear case 120 from touching the golfer's clothes or body.

In particular, the rotation shaft part 610 is formed of a double wall having a rotation rail 640 described below and distributes a load applied to the rotation clip 611 to improve durability.

Here, the rotation clip 611 is formed of a shaft member on which a helix is formed. Accordingly, one end of the shaft member is helically coupled to the rotation groove 620, and the other end of the shaft member is formed as a plate to rotate the rotation shaft part 610 about the rotation clip.

The rotation groove 620 is formed on the outer surface of the rear case 120 to accommodate the rotation shaft part 610 so that one end of the rotation clip 611 is helically coupled to the rotation groove 620.

The rail 630 is formed of a wall protruding from and along a circumference of the rotation groove 620.

The rotation rail 640 is formed of a wall spaced apart from the rotation shaft part 610 to accommodate the rail 630 and rotates in the same direction as that of the rotation shaft part 610.

In this way, the rotating part 600 rotates the tool box part 100 at a desired angle so that the towel is pulled forward and positioned during a golf game, and then the golf club face or the golf ball may be easily cleaned without removing the towel.

Meanwhile, as illustrated in FIG. 7, the golf tool kit 10 according to one embodiment of the present invention may further include a stopper 700.

The stopper 700 serves to restrict a rotation of the rotating part 600.

To this end, the stopper 700 further includes a rotation protrusion 710 and a control protrusion 720.

The rotation protrusion 710 protrudes from the inner surface of the rotation rail 640 to form a protrusion having a curved line corresponding to the circumference of the rail 630.

One surface of the rotation protrusion 710 is pressed against an outer circumferential surface of the rail 630 and rotates in response to the rotation of the rotation rail 640.

The control protrusion 720 protrudes from the outer surface of the rail 630 at an angle of at least 90° or less about the rotation shaft part 610.

That is, an outer surface of the control protrusion 720 protrudes to be pressed against the inner surface of the rotation rail 640, and thus, one side or the other side of the rotation protrusion 710 moving according to the rotation of the rotation rail 640 is pressed against the control protrusion 720.

In this case, the rotation of the rotation rail 640 is restricted, and thus, the rotation of the tool box part 100 is restricted. For this reason, the tool box part 100 is rotated at least 90° or less about a vertical line passing through the center of the rotation shaft part 610.

This is to prevent the tee inserted into the tool box part 100 from slipping out and to easily detach the towel belt 420 fastened to the towel ring 410.

According to the golf tool kit according to the present invention, the golf tool kit is detachably coupled to the belt of the golfer, and a tee, a ball marker, a brush, and a divot tool are attached to and stored in the upper surface portion and the front surface portion of the golf tool kit by the magnetic force. Accordingly, interference between the golf supplies is prevented, and thus, the golfer can easily withdraw and use the required golf supply.

In addition, when the tee with foreign substances is inserted into the tool box part, the foreign substances move along the inclined plate formed in the inner lower portion of the tool box and are guided to be discharged to the outside through the discharge hole, and thus, the tee is maintained in a cleaned state.

In addition, the towel can be quickly removed from the towel ring by releasing the button formed in the towel belt, and the towel can be folded by the attachment part. Accordingly, after temporarily storing the golf ball inside the towel, it is possible to clean the golf ball while pulling the golf ball downward using a thumb, an index finger, and a ring finger between the folded portion of the towel and the button.

In addition, the towel belt in the lower portion of the tool box part is located in the upward direction by rotating the tool box part, and thus, it is possible to easily clean the golf club face or golf ball without removing the towel by pulling the towel forward during a golf game.

In addition, the outside of the towel is waterproofed with silicone. Accordingly, even when the inside of the towel is wetted with water and carried in a folded state, the golf club face and the ball can be cleaned without getting the golfer's pants or hands wet.

Moreover, in rainy weather, it is possible to keep the inside of the towel dry so that water from wet hands or golf club grips can be wiped off.

As described above, in the detailed description of the present invention, the exemplary embodiment of the present invention is described, but the embodiment is illustrative of the most representative embodiment of the present invention and does not limit the present invention. In addition, anyone with ordinary knowledge in the technical field to which the present invention belongs may make various modifications and imitations within the scope of not departing from the scope of a technical idea of the present invention.

Therefore, the scope of the present invention is not limited to the above-described embodiments but may be implemented in various forms within the scope of the appended claims. Moreover, without departing from the gist of the present invention claimed in claims, anyone with ordinary knowledge in the technical field to which the present invention belongs is deemed to be within the scope of the description of the claims of the present invention to a wide range of modifications.

What is claimed is:

1. A golf tool kit comprising:

a tool box part in which an inner surface of a front case and an inner surface of a rear case are coupled to face each other with a buffer part provided therebetween and which has a belt clip formed on an outer surface of the rear case;

a tee storage part in which a tee is stored by being inserted into an upper portion of the tool box part;

a golf accessory storage part formed so that golf supplies are arranged on a surface of the tool box part;

a towel part formed in a lower portion of the tool box part so that a towel is replaceable; and a discharge part formed in an inner lower portion of the tool box part to discharge foreign substances to an outside of the tool box part, wherein the discharge part includes a pair of inclined plates that protrude upward from an inner lower surface of the tool box part and a pair of discharge holes formed to pass through the inner lower surface of the tool box part, each at one end of the inclined plates.

2. The golf tool kit of claim 1, wherein the tee storage part further includes:

at least one insertion hole which is formed in the upper portion of the tool box part and into which the tee is inserted;

a contact hole formed in an upper portion of an inner surface of the tool box part and formed in one surface of a plate to be pressed against an outer peripheral surface of the tee passing through the insertion hole; and a rib having a pair of plates at both sides of the contact hole.

3. The golf tool kit of claim 1, wherein the golf accessory storage part includes:

a tool storage part having grooves formed so that a divot tool is disposed in an upper portion of an outer surface of the front case, a ball marker is disposed below the divot tool, and a brush is disposed at one side of the ball marker; and a bump protruding from an outside of the tool storage part to surround a portion of each of the divot tool and the brush.

4. The golf tool kit of claim 3, wherein the golf accessory storage part further includes:

a magnet receiving part accommodating a magnet material corresponding to the tool storage part on the inner surface of the front case; and a magnet rib protruding from the inner surface of the rear case toward the magnet receiving part, wherein the magnet receiving part attaches the divot tool, the ball marker, and the brush to one surface of the tool storage part by a magnetic force of the magnet material.

5. The golf tool kit of claim 1, wherein the towel part further includes:

a towel ring formed in a lower portion of the buffer part;

a towel belt having one side sewn and coupled to an upper one surface of the towel and the other side passing through the towel ring and fastened to a button formed on one side of the upper one surface of the towel so as to form a ring button; and an attachment part formed in a lower portion of the towel so that an attachment unit is formed to fold the towel, wherein, when the towel is folded, a golf ball is temporarily stored in the attachment part and then is taken out from the attachment part.

6. The golf tool kit of claim 1, further comprising a rotating part that rotates the tool box part about the belt clip, wherein the rotating part includes:

a rotation shaft part protruding from one surface of the belt clip to rotatably receive the rotation clip;

a rotation groove formed in the outer surface of the rear case to accommodate the rotation shaft part so that one end of the rotation clip is helically coupled to the rotation groove;

a rail having a wall protruding from and along a circumference of the rotation groove; and a rotation rail that has a wall spaced apart from the rotation shaft part to accommodate the rail and rotates in the same direction as that of the rotation shaft part.

7. The golf tool kit of claim 6, further comprising a stopper that restricts a rotation of the rotating part, wherein the stopper includes:

a rotation protrusion protruding from an inner surface of the rotation rail to form a protrusion having a curved line corresponding to a circumference of the rail; and a control protrusion protruding from an outer surface of the rail at an angle of at least 90° or less about the rotation shaft part.

* * * * *